United States Patent [19]

Flum et al.

[11] Patent Number: 4,610,363

[45] Date of Patent: Sep. 9, 1986

[54] CONTAINER ASSEMBLY FOR STORAGE AND DISPLAY OF ARTICLES

[75] Inventors: Paul Flum, Ladue; Jerry M. Mynatt, Desoto, both of Mo.

[73] Assignee: Paul Flum Ideas, Inc., St. Louis, Mo.

[21] Appl. No.: 708,034

[22] Filed: Mar. 4, 1985

[51] Int. Cl.[4] ..... A47F 7/28

[52] U.S. Cl. ..... 211/74; 211/72; 248/174

[58] Field of Search ..... 211/72, 73, 132, 74; 248/174

[56] References Cited

U.S. PATENT DOCUMENTS

| | | | |
|---|---|---|---|
| 2,283,406 | 5/1942 | Bacon | 248/174 |
| 2,326,648 | 8/1943 | Horr | 248/174 X |
| 2,566,672 | 9/1951 | Nave et al. | 248/174 |
| 2,793,759 | 5/1957 | Meyers | 211/72 X |
| 3,990,601 | 11/1976 | Joyce | 211/72 X |

*Primary Examiner*—Robert W. Gibson, Jr.
*Attorney, Agent, or Firm*—Haverstock, Garrett & Roberts

[57] ABSTRACT

A container assembly for storage and display of articles formed of a plurality of parts that can be stored and shipped in substantially flat form and that can be assembled to a three-dimensional form thereby both storing the articles that are for sale and representing a display of one of the articles. A cylindrical body comprises two or more body panels preferably of resilient plastic biasing the panels toward a normally flat condition. Cooperative elongated interlocking channel members for locking the body panels together at adjacent side edges to form the cylinder. The channels are formed to interfit readily when the body panel margins adjacent the edges are substantially coplanar. The pressure biasing the body panels toward a flat position locks the interlocking channels together when the panels are curved to form a cylinder. Flanges on the channel members bear against the body panel margins adjacent the edges to stiffen those panel margins to maintain a smooth continuation of the cylindrical shape at and through the lines of interlock. Partition panels and a floor assembly are positioned within the cylindrical body. A sheet is held by interlockable channel members in a cylindrical form and has a flat lid snapped onto it to form a replica of a bottle cap. The cap replica fits on top of neck portions of the partition panels.

27 Claims, 28 Drawing Figures

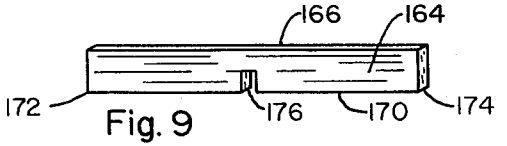
Fig. 9
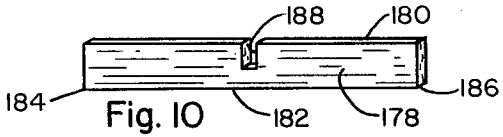
Fig. 10
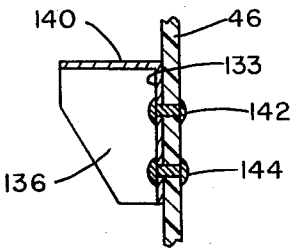
Fig. 8
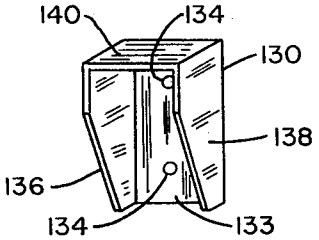
Fig. 7
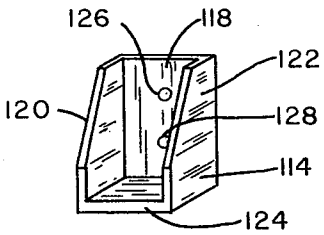
Fig. 6
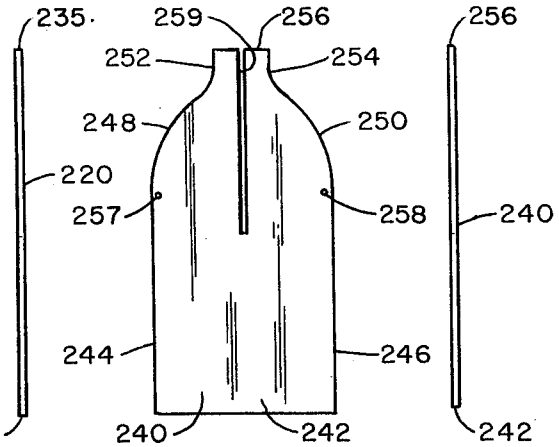
Fig. 16
Fig. 15
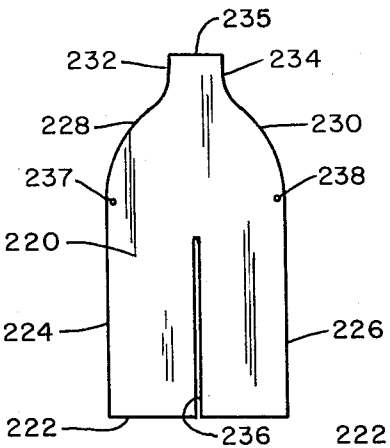
Fig. 14
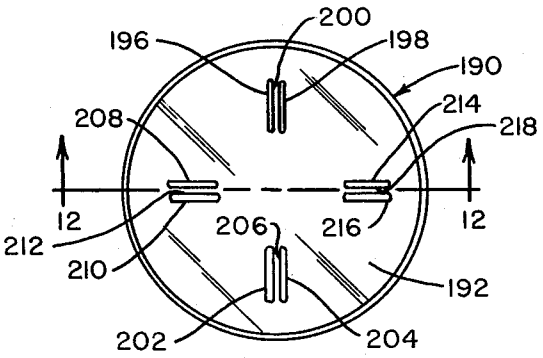
Fig. 13
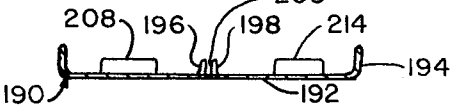
Fig. 11
Fig. 12

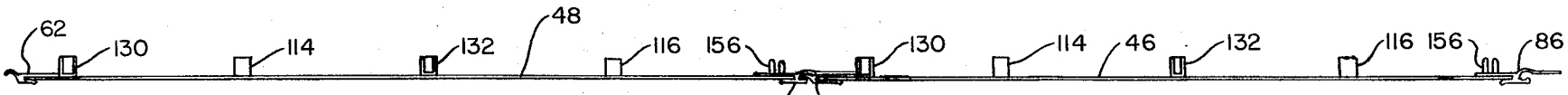
Fig. 21
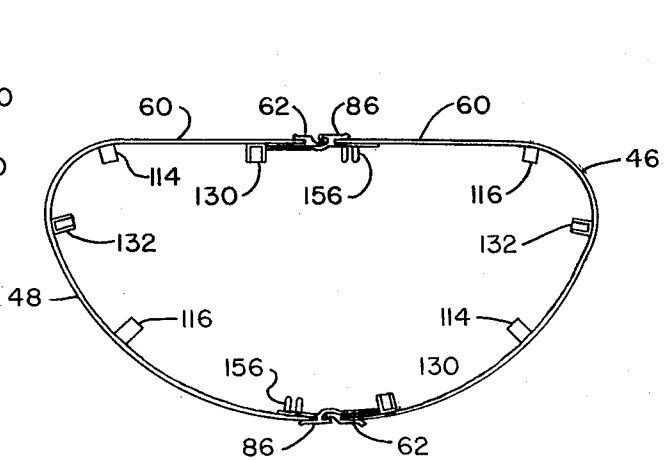
Fig. 18
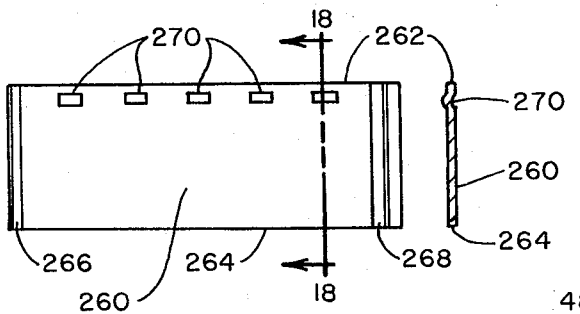
Fig. 17
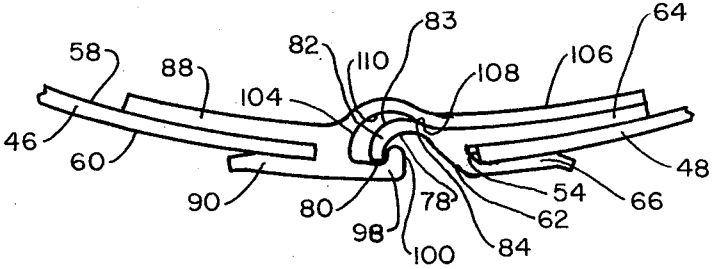
Fig. 22
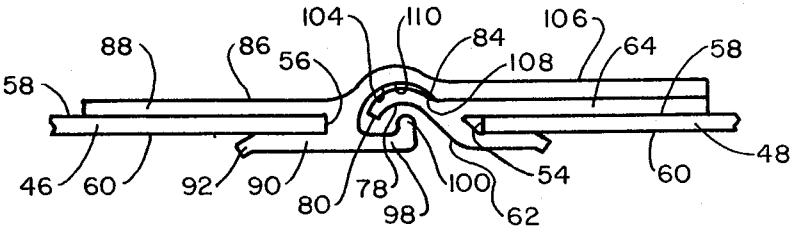
Fig. 23
Fig. 24

CONTAINER ASSEMBLY FOR STORAGE AND DISPLAY OF ARTICLES

BACKGROUND OF THE INVENTION

This invention relates to a container assembly for the storage, display, and sale of articles, such as bottled soft drinks. More particularly, the invention relates to a container assembly that is shaped to present a visual representation of the articles to prospective customers and to contain the articles in ready accessibility for removal by the customers. The container consists of separate components packaged, stored and furnished in substantially flat condition. The components can be easily assembled by one person, without the use of tools, to form a three-dimensional container. Complementary channel members along the side edges of normally flat panels are interlockable to join the panels together edge to edge. The interlockable channel members are designed so that, when the panels are curved, their bias toward normally flat shapes holds the interlocking channels in locking condition.

In the merchandising of single unit articles, such as the bottles of soft drinks that are sold in single units, it is important to have a container for storing the articles that is big enough to accommodate a large number of the articles and that is easily accessible to the prospective customer. At the same time, it is important that the storage container be sized to economize on required floor space. This is important not only because floor space in a merchandising environment is at a premium, but it offers greater flexibility in the choice of where the container may be located. Merchandisers know that the strategic location of articles that are for sale can have a great impact on the volume of sales of the articles. Another desirable characteristic of a container for such articles is that it be attractive and that it catch the eye of prospective shoppers and buyers.

This invention not only satisfies the foregoing needs, it does so in an inexpensive way in the form of components that can be stored and shipped in substantially flat condition and can be easily assembled without tools to a three-dimensional container and be held together without requiring external connectors and fasteners.

SUMMARY OF THE INVENTION

The invention comprises a container for articles to be merchandised wherein the container consists of several individual parts that can be stored and transported in substantially flat condition. A body cylinder is formed of two flat plastic body panels that are made of a substance that causes the panels to be resilient and to be biased toward their flat condition. Each body panel has a bottom edge, a top edge and two side edges. There are complementary interlockable channel members, preferably extruded of plastic, extending along the side edges of the body panels. These interlockable channel members enable the two body panels to be locked together at adjacent side edges to form a body cylinder. The design of the interlockable channel members is such that, when the body panels are in cylindrical form, the resilience of the body panels creates a pressure that retains the channel members tightly locked together. The channel members also are formed with flanges that extend past the side edges, overlying margin portions of the panels. These flanges are stiff enough to resist the resilience of the body panels that would otherwise tend to create a sharp joint along the lines of interlock. The flanges cooperate with the resilient bias or force of the body panels to maintain the curvature of the cylinder in a smooth arc through the interlocking joints of the body panels.

The inner side walls of the body cylinder have groove blocks joined to them. Each groove block, which preferably is of molded plastic, has a straight groove formed in it. The groove blocks are positioned so that the grooves are vertically oriented and are equally spaced in four vertical lines about the inner circumference of the body cylinder.

At the lower edges of the body panels there are four joist hangers, preferably plastic. These joist hangers are located adjacent the bottom edges of the body panels so that when the body panels are assembled to form the body cylinder, the four joint hangers are equally spaced about the circumference of the cylinder adjacent its lower edge. A few inches above the joist hangers there are four floor support brackets, also preferably of plastic. The floor support brackets are equally spaced about the circumference of the body cylinder and are positioned intermediate the joist hangers.

A floor assembly comprises three components. Two of the components are joist members, such as one-by-fours of either plastic or wood, or other suitable material, having complementary notches at their centers so that they can be assembled together in the form of a cross. In that form the joists fit within the body cylinder with their lower corners resting within and supported by the four joist hangers. The height of the floor joists puts their upper surfaces at the same level as the floor support brackets.

The third component of the floor assembly is a round floor member. The floor member may be vacuum formed plastic and is formed with upwardly extending projections defining straight horizontal grooves extending radially, equally spaced about the floor member. There is an upwardly extending peripheral wall formed about the outer perimeter of the floor member. The floor member can be inserted into the body cylinder to rest upon the joists and the floor support brackets, and should be oriented so that its radial grooves are aligned with the vertical grooves in the groove blocks on the inner side wall of the body cylinder. The upwardly extending peripheral wall fits within and against the inner side wall of the body cylinder.

A partition assembly comprises two flat partition panels. Each partition panel is shaped to resemble the outline of one of the articles that is to be stored for sale in the container. For example, if the articles are individual soft drink bottles, each partition panel may have vertical side edges that are preferably at least as tall as the body cylinder. Thereabove, the sides might be curved inwardly and then extend upwardly to depict an upper neck resembling the upper neck portion of the soft drink bottle.

The partition panels have complementary vertical slots along their axial centers that enable the two panels to be interlocked together at right angles to one another. As so assembled, the partition panel assembly fits within the body cylinder and rests upon the floor member with the bottom edges of the partition panels fitted within the grooves on the floor and the side edges fitted within the grooves in the groove blocks on the inner cylindrical wall. In this arrangement the panel assembly defines four compartments or bins for receiving articles of merchandise. The floor of these bins is defined by the floor member which provides ample support because of the floor joists and the floor support brackets. The outer wall of the bins is defined by the body cylinder panels. The cylindrical shape, held firmly by the interlocking channels, enhances the strength of the outer cylindrical wall. The partition panels define the side walls of the bins. Clearly, the vertical grooves help the partition panels resist rotational or twisting force. This resistance is aided by the grooves on the floor member, particularly toward the lower levels of the bins where the pressure exerted by the articles is the greatest.

A cap assembly that is to depict the top of the article, such as a bottle cap, comprises two substantially flat components. One of these is a flat sheet, preferably vacuum formed plastic biased to seek a normally flat condition. Opposite side edges of the flat sheet have complementary channel members that may be identical to but smaller than the channel members on the body cylinder panels. The flat sheet can be bowed to form a small cylinder with the complementary interlocking channel members in interlocking engagement to retain the sheet in the cylindrical form.

The other component of the cap assembly is a lid that has an annular side flange. The lid also may be of vacuum formed plastic. The lid fits on the small cylinder with the annular side flange surrounding the upper portion of the small cylinder. Preferably, the sheet has outward projections or detents and the annular side flange has an inner peripheral recess that snaps over and receives the detents to keep the lid on the small cylinder. The cap assembly can be fitted over the neck portions of the partition panel assembly. The cylinder of the cap assembly encircles the upper side edges of the partition panels and helps hold them in centered positions.

The overall effect of the container assembly is a large facsimile of an article such as a soft drink bottle, and a large container for storing a plurality of the articles. The container assembly can be stored and shipped in a compact flat package and can be readily assembled by one person to a three-dimensional form. The interlocking channels are sufficiently strong to hold the panel edges together and are designed to maintain the cylindrical shape of the body cylinder. The partition panel assembly not only forms the body of the soda bottle above the cylinder but it also defines partitions for four bins that are collectively accessible from any direction about the container assembly.

An object of the invention is to provide a container assembly for holding individual articles that are for sale wherein the container assembly comprises several parts that may be stored and shipped as a substantially flat, compact package and when assembled, the combined components constitute a three-dimensional representation of one of the articles being stored for sale.

Another object of the invention is to provide a container assembly for merchandising articles that normally are bought individually, the container assembly being constructed of several components of plastic material that, when assembled, provide a strong and rigid container having joints capable of withstanding outward pressure and that is suitable for resting on a floor such as in the aisle of a retail store.

Another object of the invention is to provide a container assembly for articles that represents the appearance of one of the articles and that provides access to the articles from all positions surrounding the container assembly.

Another object of the invention is to provide a container assembly for articles that are for sale comprising individual components that can be stored and shipped in substantially flat condition, that can be assembled quickly without tools by non-skilled personnel, that is self-locking in the assembled condition without external fasteners, and that when assembled represents a three-dimensional display of an article that is for sale.

Another object of the invention is to provide a container assembly for articles of merchandise that may be constructed of inexpensive plastic and/or hardboard materials and yet is rugged and will withstand the abuse of a central display in a high traffic shopping area.

Another object of the invention is to provide interlockable channel members adapted to join edges of panels that are normally flat but are to be stressed to curved configurations wherein the channel members have complimentary hooks that can be interengaged when the panels are substantially flat and that include stops preventing release of the hooks when the channel members are pivoted relative to one another upon curving the panels. A related object is to provide such interlocking channel members with relatively stiff flanges overlying the panels adjacent the joined edges to prevent the panels from hinging along the joint line and to thereby maintain continuity of the curve through the joint line.

Still another object of the invention is to provide interlockable channel members as aforesaid having interengaging hooks that can be released from one another upon pressing the panel portions adjacent and through the joint line to a substantially coplanar condition.

Other objects and advantages will be apparent from the detailed description, drawings, and claims which follow.

BRIEF DESCRIPTION OF THE DRAWINGS

FIG. 6 is an enlarged perspective view of a joist hanger;

FIG. 7 is an enlarged perspective view of a floor support bracket.

FIG. 8 is an enlarged view in section of a floor support bracket taken along the line 8—8 of FIG. 2.

FIG. 9 is a perspective view of one floor joist;

FIG. 10 is a perspective view of the other floor joist;

FIG. 11 is a top plan view of the floor member;

FIG. 12 is a view in section of the floor member taken along the line 12—12 of FIG. 11;

FIG. 13 is a front elevation view of one of the partition panels;

FIG. 14 is a side edge elevation view of the partition panel of FIG. 13;

FIG. 15 is a front elevation view of the other partition panel;

FIG. 16 is a side edge view of the partition panel of FIG. 15.

FIG. 17 is a side elevation view of the cap sheet;

FIG. 18 is a view in section of the cap sheet taken along the line 18—18 of FIG. 17;

FIG. 21 is a top edge view on a reduced scale of the two body panels with two adjacent channel members interfitted;

FIG. 22 is a top edge view of the two partition panels showing how the body panels are compressed to enable their other two edges to be joined together by interfitting the interlocking channel members;

FIG. 23 an enlarged top view of the channel members showing their relative positions during interfitting at the beginning of the locking process;

FIG. 24 is an enlarged top view of the channel members showing their relative interlocking positions when the partition panels have been released to assume their cylindrical position;

DESCRIPTION OF THE PREFERRED EMBODIMENT

Figure 1:
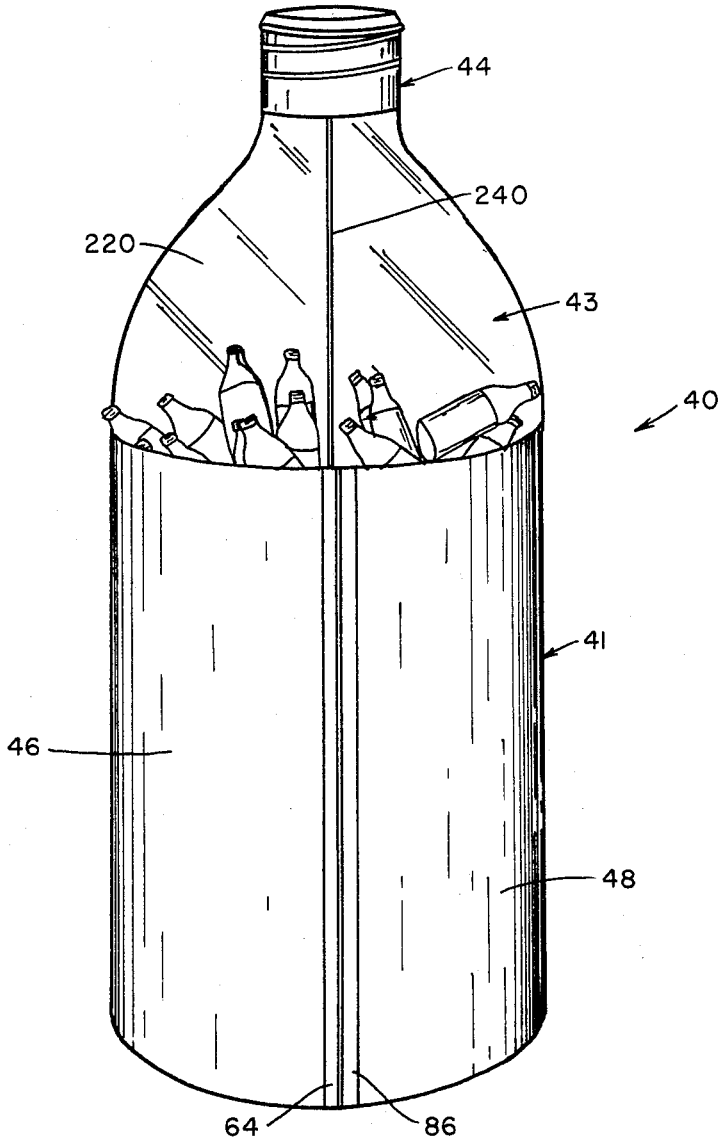
FIG. 1 is a perspective view of the container assembly for storage and display of articles, showing all components in assembled form.
Figure 27:
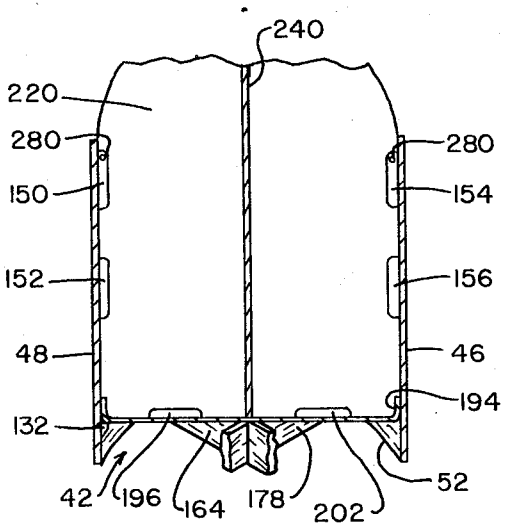
FIG. 27 is a partial perspective view in section showing the floor member positioned on the floor joists and on the floor support brackets, and showing the partition panels connected together and positioned within the cylinder.

Referring to FIG. 1 of the drainings, this container assembly 40 comprises a body assembly 41, a floor assembly 42 (FIG. 27), a partition assembly 43, and a cap assembly 44. When all of the components are combined to form the container assembly 40, as illustrated in FIG. 1, the result is a three dimensional container assembly that can store a large number of articles, such as soft drink bottles, and that constitutes a three dimensional display of one of the articles. Yet, all the components can be stored and packaged in a substantially flat condition as will be described.

Figure 2:
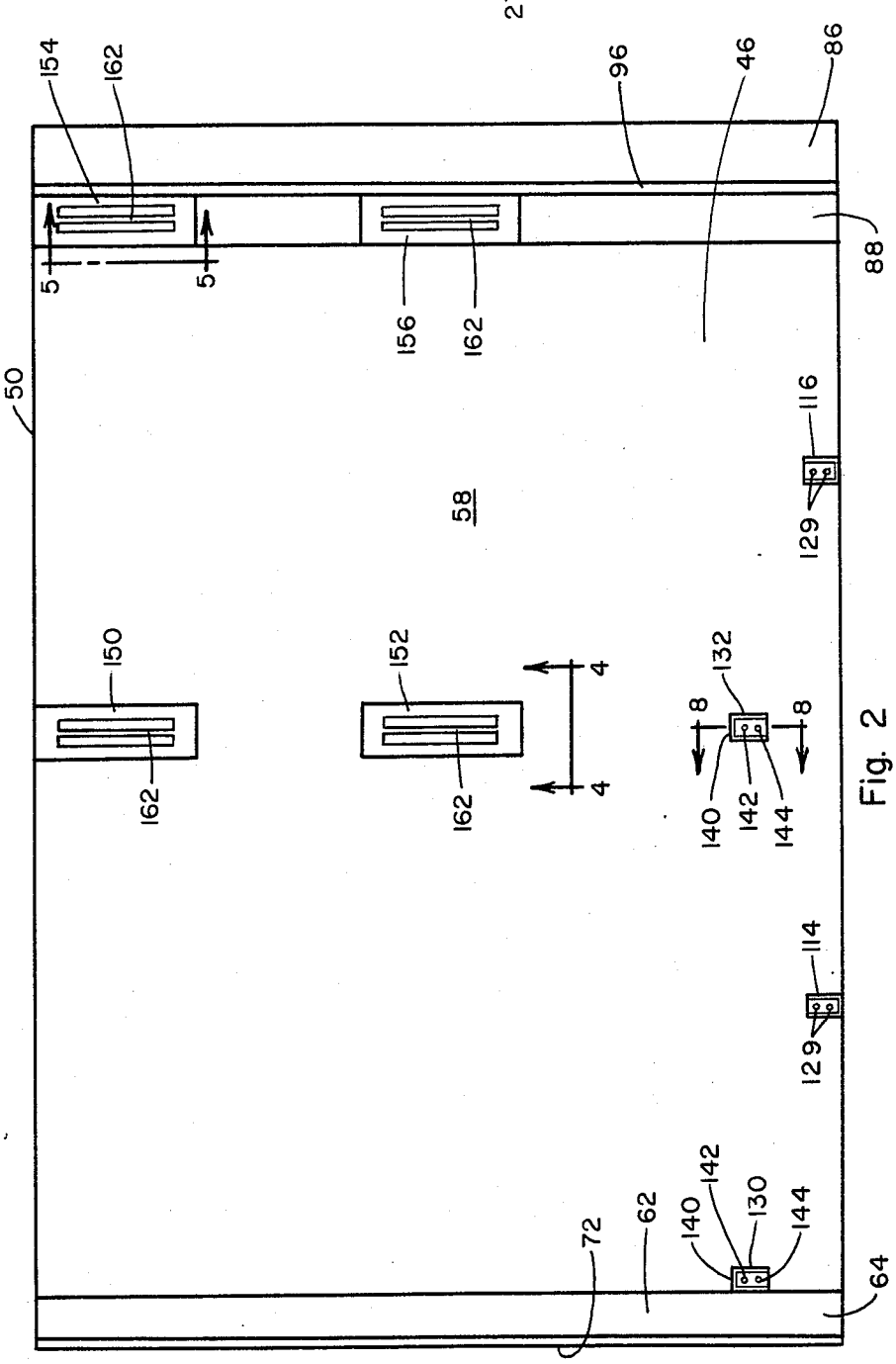
FIG. 2 is a side elevation view of one of two identical body panels and its components shown in its normal flat condition.
Figure 3:
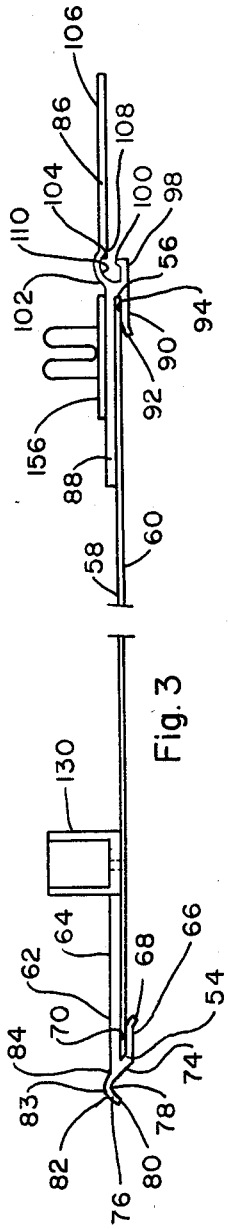
FIG. 3 is an enlarged top edge view, partially broken away, of the panel of FIG. 2.

The body assembly 41 comprises two body panels 46 and 48. One of these body panels 46 is shown in FIGS. 2 and 3 and various of its components are shown in FIGS. 4, 5, 6, 7 and 8. The other body panel 48 and its components is identical to the body panel 46 and its components. Therefore, only one of the body panels 46 will be described in detail.

As shown in FIGS. 2 and 3, the body panel 46 is in the form of a rectangle and preferably is formed of resilient plastic. The body panel 46 has a top edge 50, a bottom edge 52, and side edges 54 and 56 (see FIG. 3) which define the perimeters of an inner surface 58 and an outer surface 60. References hereinafter to "inner" and "outer" or "inwardly" and "outwardly" are with respect to these inner and outer surfaces 58 and 60. Each body panel is about 2 feet 8 inches high and about three feet two inches wide. Although these dimensions may be varied over wide ranges, they suffice to produce a body cylinder 41, as will be described, that can hold about two hundred 16 ounce bottles, that can be reached into over its top edge, and that economizes on floor space. The body panel 46 is about one-eighth inch thick and this thickness cooperates with the plastic composition to give the panel strength as well as an internal memory or resilience biasing the panel toward the normally flat condition illustrated in FIGS. 2 and 3. However, if the two side edges 54 and 56 are pressed toward one another, the panel 46 can be bowed or curved in opposition to its internal resilient force, and under these conditions, the panel will tend to assume an arcuate shape.

A channel member 62 extends along the side edge 54 of the channel 46. The channel member 62 is preferably formed of extruded plastic of a composition causing the channel member to be fairly stiff but yet possess some resilience. As shown particularly in FIG. 3, the channel member 62 has a long flange 64 that lies along a margin portion of the inner surface 68 of the body panel 46 adjacent the edge 54. The channel member 62 also has a short flange 66 having an out turned lip 68. The flange 66 is parallel to the long flange 64 and lies against a margin portion of the outer surface 60 adjacent the edge 54 of the body panel 46. A recess 70 that is about as wide as the thickness of the body panel 46 is defined between the long flange 64 and the short flange 66. The edge 54 and adjacent margin portions of the body panel 46 are positioned within the recess 70, and the contacting surfaces are bonded together by a suitable cement or by any other suitable fastening means.

The channel member 62 also has a stem 74 extending from the short flange 66 past the long flange 64 at approximately a 45° angle thereto. Beginning at about the inner side of the long flange 64, the channel member 62 has a hook end 76 that is curved to define an outwardly facing recess 78. The hook end 76 terminates in an edge 80 that also faces generally outwardly. As can be seen in FIG. 3, the convex surface 82 of the hook end 76 is curved and has an apex 83 that is spaced inwardly of the long flange 64. This convex surface 82 of the hook member 76 intersects the long flange 64 along a crease line 84 that serves as the seat of a notch.

Adjacent the other edge 56 of the panel 46 is another extruded channel member 86 of the same plastic composition as the channel member 62. As shown in FIG. 3, the channel member 86 has a long flange 88, overlying the margin portion of the inner surface 58 of the panel 46 that is adjacent the edge 56. A short flange 90 having an out turned lip 92 lies against the margin portion of tne outer surface 60 of the panel 46 adjacent the edge 56. The long flange 88 and the short flange 90 are parallel to and spaced from one another, defining a recess 94 between them. The edge 56 and adjacent margin portions of the sides 58 and 60 extend within the recess 94, and the contacting surfaces are cemented or otherwise joined together.

The channel member 86 has a short leg 98 that is generally in line with the short flange 90, but extends in the opposite direction. The short leg 98 terminates in an inwardly extending rib 100. From the short leg 98, where it joins the short flange 90, the channel member 86 has a curved hook retainer body 102, the inner surface 104 of which is curved with a radius somewhat larger than the radius of the convex surface 82 of the hook end 76. The curved hook retainer body 102 extends to and terminates at a straight long leg portion 106 of the channel member 86. The inner surface 104 of the curved body 102 intersects the long leg portion 106 along a termination line or apex 108 that functions as a stop, as will appear. The channel members 62 and 86 are complementary to one another as will be described hereinafter. These channel members 62 and 86 provide a unique connecting means between the body panels 46 and 48.

Continuing with the description of the body panel 46 and its components, a pair of joist hangers 114 and 116 are connected to the body panel 46 adjacent the lower edge 52. As shown in FIG. 6, each joist hanger 114 and 116, which is preferably of molded plastic, has a back wall 118, a pair of side walls 120 and 122, and a bottom wall 124. The back wall 118 has a pair of holes 126 and 128 through it, and the hangers may be connected to the body panel 46 by rivets 129 through the holes 126 and 128.

There are two shelf brackets 130 and 132 fastened to each panel 46. As shown particularly in FIGS. 7 and 8, each shelf bracket 130 and 132 has a back wall 133 with holes 134 in it, a pair of reinforcing side walls 136 and 138, and a top wall 140. The shelf brackets are fastened to the panels 46 by a pair of rivets 142 and 144 that extend through the holes 134. It should be noted that the shelf brackets 130 and 132 are positioned laterally intermediate the joists 114 and 116 so that, when the two panels 46 and 48 are joined together as a cylinder as will be described, the joists and shelf brackets are staggered about the periphery of the cylinder. It should also be noted that the vertical distance from the upper surfaces of the bottom walls 124 of the joist hangers 114 and 116 to the top walls 140 of the shelf brackets 130 and 132 is approximately equal to the height of floor joists to be described, used in conjunction with the assembly.

Vertically aligned approximately midway between the two side edges 54 and 56 of the panel 46, a pair of groove blocks 150 and 152 are glued to the inner side 60 of the channel 46. Another pair of grooved blocks 154 and 156 are vertically aligned and glued to the inner surface of the long flange 88.

Figure 4:
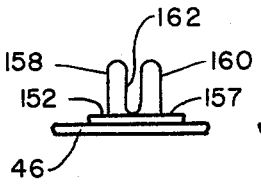
FIG. 4 is an enlarged view in section taken along the line 4—4 of FIG. 2, particularly illustrating an end view of a groove block.
Figure 5:
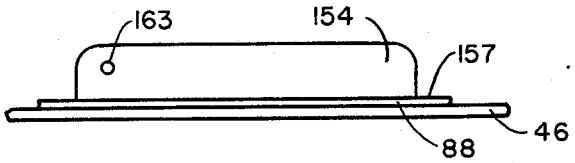
FIG. 5 is an enlarged view in section taken along the line 5—5 of FIG. 2, illustrating a side view of a groove block.

The groove blocks 150, 152, 154 and 156 are substantially identical, and an end view of one of them (for example, the groove block 152) is shown in FIG. 4 and a side view of another groove block 154 is shown in FIG. 5. Each of the groove blocks has a base 157 by which it can be glued to a flat surface, such as the panel 46 or the long flange 88. A pair of spaced projections 158 and 160 extend from the base 157 and define a groove 162 between them. Horizontally aligned holes 163 may be provided in the projections 158 and 160 of the groove block 154 for a purpose to be described. The groove block 150 may have similar holes. The grooves 162 of the blocks 150 and 152 are vertically aligned and the grooves 162 of the blocks 154 and 156 are vertically aligned. The vertical line of the groove blocks 150 and 152 is spaced from the vertical line of the groove blocks 154 and 156 so that they will be about 90° apart when the two panels 46 and 48 are assembled as a cylinder, to be described hereinafter.

Figure 26:
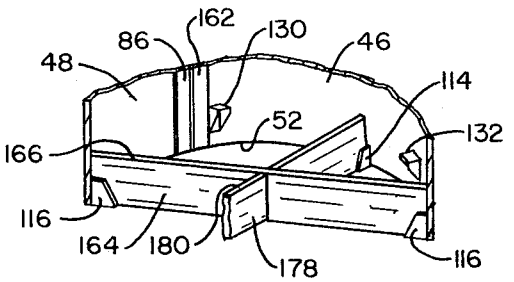
FIG. 26 is a partial perspective view in section of the lower portion of the container assembly prior to installation of the floor member, particularly illustrating the floor joists positioned within the joist hangers inside the cylinder.
Figure 25:
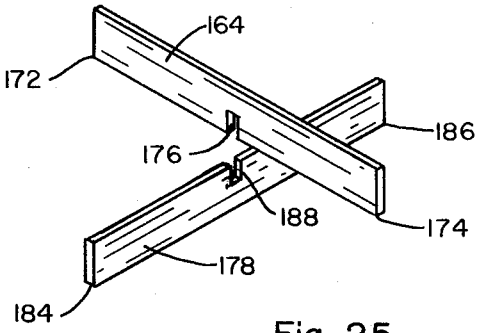
FIG. 25 is a perspective view of the floor joists in the process of being assembled together.

FIG. 9 illustrates a joist 164 that may be cut from a one-inch by four-inch wood board. Other materials, such as plastic, and other dimensions, may be used. The joist 164 has a top edge 166, a bottom edge 170 and lower corners 172 and 174. At the center of the joist 164 and extending from the lower edge 170, a notch 176 is cut slightly wider than the width of the joist 164 and extending about half the height of the joist. In FIG. 10 a companion joist 178 is shown having a top edge 180, a bottom edge 182, and lower corners 184 and 186. At the center of the joist 178, a notch 188 extends from the top edge 180 downwardly a distance about half the height of the joist. The notch 188 is slightly wider than the width of the joist. The notches 176 and 188 are complementary to enable the joists 164 and 178 to be fitted together as indicated in FIGS. 25 and 26.

FIGS. 11 and 12 illustrate a floor member 190 that in plan view is in the form of a circle. The floor member 190 has a floor panel 192 and a peripheral verticle wall 194 that is approximately three to four inches high. A pair of projections 196 and 198 extend upwardly from the floor panel 192 and define a groove 200 between them. Another pair of projections 202 and 204 extending upwardly from the floor panel 190 define another groove 206. The grooves 200 and 206 are aligned along a diameter of the floor 190. Similarly, another pair of upwardly extending projections 208 and 210 define a groove 212 between them, and a pair of upwardly extending projections 214 and 216 define another groove 218 between them. The grooves 212 and 218 are aligned along a diameter of the floor 192 that is at right angles to the line of the grooves 200 and 206. The floor member 190, with its peripheral vertical wall and the projections, is preferably of vacuum formed plastic.

FIG. 13 illustrates a partition panel 220 that may be made of a suitable hardboard, such as masonite. The panel 220 has a bottom edge 222 and side edges 224 and 226 that are parallel as they extend upwardly from the bottom edge 222 for distances that are equal to or slightly greater than the height of the panels 46 and 48. The parallel edges 224 and 226 then converge in curved portions 228 and 230 and then curve upwardly again at concave-to-straight portions 232 and 234 that define a neck. There is a top edge 235 extending between the upper ends of the side edges 232 and 234. The outline thus defined, which may be varied without departing from the scope of the invention, resembles the outline of a soft drink bottle, particularly the 16 ounce kind.

There is a vertical slot 236 extending upwardly from the bottom edge 222 of the panel 220. The slot 236 is slightly wider than the thickness of the panel 220 and extends upwardly a distance approximating half the height of the panel 220. The panel 220 may be provided with two small holes 237 and 238 adjacent the side edges 224 and 226. The purpose for these holes will be described hereinafter.

A second partition panel 240, complementary to the panel 220, is shown in FIGS. 15 and 16. The partition panel 240 has a bottom edge 242 and parallel side edges 244 and 246 that correspond to the side edges 224 and 226 of the panel 220. Thus, the side edges 244 and 246 have upwardly curved converging portions 248 and 250 that lead to short vertical extensions 252 and 254 to define a neck. The panel 240 also has a top edge 256. There may be two small holes 257 and 258 adjacent the side edges 244 and 246. A vertical slot 259 extends downwardly from the top edge 256 half the distance toward the bottom edge 242. Because of the slots 236 and 259, the panels 220 and 240 can be interlockingly fitted together at right angles.

Referring to FIGS. 17 and 18, a rectangular cap sheet 260 is preferably of vacuum formed plastic. The cap sheet 260 has an upper edge 262 and a lower edge 264. Complementary extruded plastic channel members 266 and 268 are glued or appropriately joined to the cap sheet 260 adjacent its side edges. The channel member 266 may be substantially identical to the channel member 62 except on a smaller scale, and the channel member 268 may be substantially identical to the channel member 86 except on a smaller scale. Thus the channel members 266 and 268 are complementary to one another as will appear. The cap sheet 260 is formed with a plurality of outwardly extending detents 270 spaced slightly below the upper edge 262.

Figure 19:
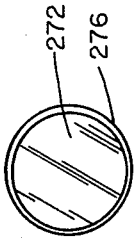
FIG. 19 is a plan view of the lid for the cap.
Figure 20:
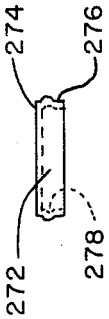
FIG. 20 is a side elevation view of the lid.

FIGS. 19 and 20 illustrate a vacuum formed plastic lid 272. The lid 272 has a top panel 274 and an annular side wall 276. An outwardly extending annular groove 278 is formed in the side wall 276. The groove 278 is complementary in cross section to the detents 270 on the cap sheet 264.

The various components which have now been described are normally stored and shipped in a flat condition. They may be packaged in a single carton that is only about four inches thick. Assembly is very easy and can be done by one person without the use of any tools. To put together the components and form the container assembly 40 that is illustrated in FIG. 1, the body 41 is first put together. This body 41 consists of the two identical panels 46 and 48. The panels 46 and 48 are first oriented so that the channel member 62 of one panel is adjacent the channel member 86 of the other panel as shown in FIG. 21. This may be done with the body panels lying on a floor, inner sides 58 facing upwardly, or with the body panels standing on their bottom edges 52. Then, with the body panels 46 and 48 substantially coplanar, at least adjacent the proximate channel members 62 and 86, the channel members 62 and 86 can be interfitted. This is particularly illustrated in FIG. 23 which shows that if the body panels 46 and 48 are substantially coplanar or even swung slightly so that the outer surfaces 60 of the panels 46 and 48 define an obtuse angle, the hook end 76 of the channel member 62 can pass through the space between the rib 100 and the opposing apex 108. Once the end free 80 of the hook end 76 is within the hook retainer body 102 and has cleared the rib 100, the channel members can be locked together. This is accomplished by swinging the body panels 46 and 48 so that their inner surfaces 58 move toward one another, i.e. to define an angle of less than 180°. In other words, as the body panels 46 and 48 are curved toward a cylindrical condition, the channel members 62 and 86 are pivoted toward the positions shown in FIG. 24.

The way these channel members 62 and 86 are joined together and interlocked is particularly illustrated by the configurations of FIGS. 23 and 24. In FIG. 23 the hook end 76 has passed through the space between the rib 100 and the apex 108 and is within the hook receptacle body 102. In this position, the arcuate hook end 76 is generally co-axial with the arcuate hook receptacle body 102, and the rib 100 is generally at the concentric centers of these members. In the relative positions illustrated in FIG. 23, if the panels were pulled apart, the hook end 76 could pass through the space between the rib 100 and the inner wall 110 because the apex 108 could ride over the convex surface 82 as the hook end 80 passes over the rib 100. However, if the channel members are pivoted relative to one another in directions that produce a concave shape on the inner sides 58 of the body panels and a convex shape on the outer sides 60, the hook end 76 will be rotated to a position behind the rib 100. As this rotation continues, the free end 80 of the hook end 76 contacts the short leg 98 and the projection apex 108 fits within the notch seat 84, thus interlocking the channel members together. In this interlocked condition the rib 100 acts as a stop and the contact area between the notch seat 84 and the projection apex 108 acts as another stop. The configuration of the channel members illustrated in FIG. 24 is established when the body panels 46 and 48 are curved toward a cylindrical shape as illustrated by the lower portion of FIG. 22 (the upper portion of which has been temporarily flattened for reasons which will now be described).

Having joined and interlocked the first pair of channel members 62 and 86, to lock the second pair of channel members 62 and 86, they too must be introduced toward one another in a substantially coplanar configuration. This is accomplished as illustrated in FIG. 22 by first bringing the channel members 62 and 86 into proximity to one another by curving the body panels 46 and 48 into generally cylindrical or semi-cylindrical forms. In a cylindrical shape, even with the channel members 62 and 86 in contact, they will not interlock because the rib 100 will block passage of the hook end 76 past it into the hook retainer area.

To present a wider space facing the hook end 76, the second pair of channel members 62 and 86 must be pivoted relative to one another. This is accomplished by pressing the areas of the panels 46 and 48 adjacent these channel members and temporarily bringing them into coplanar positions, as illustrated at the upper portion of FIG. 22, or even pressing them past coplanar so that their outer surfaces 60 define an angle of less than 180°. Then, as again illustrated in FIG. 23, the hook end 76 can pass through the space between the rib 100 and the apex 108 into the area that defines the hook receptacle, to be positioned as illustrated in FIG. 23. Now, while holding the second pair of channel members 62 and 86 in these relative positions, the pressure on the outer surfaces 60 of the panels 46 and 48 is gradually released. The internal bias or resilience of the plastic that constitutes the panels 46 and 48 will cause them to seek a cylindrical shape, rotating the second pair of channel members 62 and 86 to the relative positions illustrated in FIG. 24, interlocking them together. Again, in the positions illustrated in FIG. 24, the apex 108 of the channel member 86 is seated in the notch 84 of the channel member 62 and the outer edge 80 of the hook end 76 is seated against the short leg 98 behind the rib 100.

In these interlocked conditions, the two body panels 46 and 48 form the cylindrical body 41. In the cylindrical condition, the groove blocks 150 and 152 of one body panel 46 are diametrically opposite the groove blocks 150 and 152 of the other body panel 48. Likewise, the groove blocks 154 and 156 of the two body panels are diametrically opposite one another and are spaced about 90° from the groove blocks 150 and 152. Similarly, the joist hangers 114 on the two body panels 46 and 48 are diametrically opposite one another, and the joist hangers 116 are diametrically opposite one another, and displaced about 90° from the joist hangers 114.

With the body 41 thus formed, the floor assembly 42 can be put together. This may begin with the interconnection of the floor joists 164 and 168. As illustrated in FIG. 25, these joists are oriented at right angles to one another with the notches 176 and 188 on a central axis. Then the joists 164 and 178 are brought together with the notches 176 and 188 producing an interlock. Next the interlocking joists 164 and 178 are positioned within the cylindrical body 41 with the lower corners 172 and 174 of the joists 164 and the lower corners 184 and 186 of the joists 178 positioned within the joist hangers 114 and 116. In this position, the upper edges 166 and 180 of the joists 164 and 178 are approximately in the same horizontal plane as that of the top walls 140 of the shelf brackets 130 and 132.

Next the floor member 190 may be placed within the body 141 on top of the floor joists 164 and 178. In this position, the floor member 190 will also rest upon the floor support brackets 130 and 132. Therefore, even though the floor member 190 is not of itself particularly strong, being of vacuum formed plastic, the supports provided by the floor joists 164 and 178 combined with the floor support brackets 130 and 132 to fully reinforce the floor member 190. Also, in position, the peripheral side edge 194 of the floor member 190 projects upwardly in contact with or close proximity to the inner side wall of the cylindrical body 41. This peripheral side wall 194 acts as a splash guard in the event of any spillage of the contents of a soft drink container which otherwise would spill onto the underlying floor of the building.

The floor member 190 should be oriented so that the line defined by the grooves 200 and 206 is in the plane of the grooves 162 in the diametrically opposing groove blocks 150 and 152. In this position, the line defined by the other grooves 212 and 218 will be aligned with the plane defined by the grooves 162 in the other diametrically opposed groove blocks 154 and 156.

The partition panels 220 and 240 may now be installed. This may be done individually or the partition panels 220 and 240 may be put together. If done individually, the partition panel 240 is inserted into the body 41 through the top opening thereof. As the bottom edge 242 of the partition panel 240 passes below the upper edge 50 of the cylindrical body 41, its side edges 244 and 246 should be aligned with a diametrically opposite pair of vertical grooves 162 in diametrically opposed groove blocks, such as the groove blocks 154. Then as the partition panel 240 is allowed to slide downwardly, its side edges will slide through the grooves 162 until the lower corners reach the lower groove blocks 156. Then the side edges 244 and 246 should be guided into the grooves 162 of the groove blocks 156 and the partition panel 240 further lowered. When the partition panel 240 reaches the floor member 190, the bottom edge 242 will probably fall into the aligned grooves 212 and 218. At most, a little manual guidance will produce the necessary alignment so that the panel can seat between the projections 208 and 210 and the projections 214 and 216, which act as lateral stops.

With the partition panel 240 thus in place, the other partition panel 220 can be started downwardly from the upper edge 256 of the partition panel 240, with the slots 236 and 259 aligned. Then the partition panel 220 can be lowered into the body 41 through the upper opening. As this partition panel 220 slides vertically downwardly, its side edges 224 and 226 should be guided through the grooves 162 in the upper diametrically opposite groove blocks 150. As the partition panel 220 is lowered further, its side edges are guided into the grooves 162 of the lower groove blocks 152 and the body of the partition panel 240 is received within the slot 236 as the body of the partition panel 220 is received within the slot 259. Finally, the partition panel 220 is low enough to have its lower edge 222 received within the grooves 200 and 206 in the floor member 190 and is seated. In this condition, the two partition panels 220 and 240 are at right angles to one another and generally present a replica of the outer contour of a soft drink container, such as one for a 16 oz. bottle.

When the partition panels 220 and 240 are thus installed, the holes 237 and 238 will in the panel 220 align with the holes 163 in the groove blocks 150, and the holes 257 and 258 in the panel 240 will align wih the holes 163 in the groove blocks 154. Bolts 280 may extend through these various aligned holes (See FIG. 27) with nuts tightened manually onto the bolts 280. These bolts 280 are not needed for the strength and integrity of the final assembly, but are helpful if it is desired to relocate the container assembly 41 by grasping and lifting the partitions 220 and/or 240.

The cap assembly 44 now can be put together. Referring to FIG. 17, it has already been stated that the channel members 266 and 268 are much smaller than but are similar in construction to the channel members 62 and 86 that have already been described. In the case of the cap assembly 44 however only a single cap sheet 260 is used rather than the dual body panels that form the body 41.

To form the cap cylinder, the sheet 260 is bowed or curved until the cylinder is formed with the channel members 266 and 268 adjacent to one another. Then, in a manner similar to the illustration of FIG. 22, the portions of the sheet 260 adjacent the channel members 266 and 268 are pressed to make them substantially coplanar so that the channel members 266 and 268 will interengage. Then when the sheet is released and springs to its cylindrical shape under the influence of the internal resilience of the sheet, the channels 266 and 268 become interlocked. This process is similar to that described in conjunction with FIGS. 23 and 24 and the channel members 62 and 86 and need not be described in detail.

Figure 28:
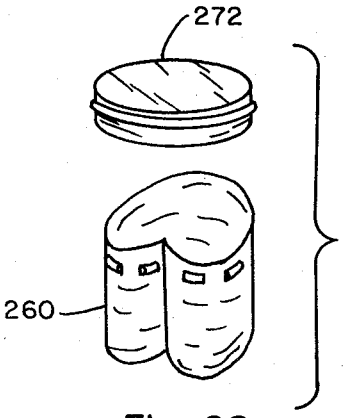
FIG. 28 is a perspective view of the small cylinder and lid showing the manner in which they are assembled.

When the cap cylinder has been formed, the lid 272 is snapped in place. This is best done as illustrated in FIG. 28 with the channel members 266 and 268 pressed inwardly to reduce the overall diameter of the cylinder defined by the sheet 260. Then, the cap 272 can be overlaid and the cylinder released. This will cause the sheet 260 to snap back into a cylindrical form with the detents 270 fitting within the annular groove 278 in the lid 272. Putting together of the cap assembly 44 is now complete.

The final step is to place the cap assembly 44 on the neck portions 232, 234, 252 and 254 of the partition panels 220 and 240. The final container assembly 40 is illustrated in FIG. 1. This container assembly is an attractive replica of the soft drink bottles which it stores for sale. It can hold as many as two hundred 16 ounce bottles, yet is only about 2 feet in diameter. It can occupy a prominent place in a store with efficient use of floor space.

If the container assembly 40 is empty or nearly empty, it can be lifted and moved. The bolts 280 that fasten the partition panels 220 and 240 to the groove blocks 150 and 154 enable the container assembly 40 to be lifted by grasping one or both of the partition panels 220 and 240.

At any time desired, the container assembly 40 can be disassambled and re-packaged for flat storage by simply reversing the procedure that has been described. Thereafter, it can be reassembled.

Although this container assembly has been described in connection with the storage and display of soft drink bottles, it could be used for other articles of merchandise. Also, the shape of the container assembly could be modified to resemble the shape of other articles. In addition, changes and variations in dimensions and materials are possible within the scope of the invention.

Although the foregoing description and the drawings describe and illustrate a container assembly that fulfills the objects and advantages sought therefor, variations and modifications are contemplated as may be apparent to those skilled in the art and may be encompassed within the scope of the claims which follow.

What is claimed is:

1. A container assembly for containing and displaying products comprising a hollow cylindrical body defined by resilient normally flat panel means curved to form a cylindrical side wall and a removable round floor member within and at the base of the cylindrical side wall, fastening means for joining side edges of the panel means to releasably form the panel means in a cylindrical shape, partition means within the cylindrical body having side edges in contact with the inner side wall of the cylindrical body and having bottom edges that contact the floor member, means defining joists extending transversely between opposite points on the inner side wall of the cylindrical body, means on the side wall for removably supporting the joists, the floor member being positioned to rest upon the joists for reinforcement of the floor, and means defining grooves at selected positions within the cylindrical body to receive selected edges of the partition means.

2. The container assembly of claim 1 wherein the partition means comprises two partition panels, means at about the vertical centers of the partition panels for interlocking the partition panels together to cooperate with the cylindrical body and therewith define four compartments.

3. The container assembly of claim 1 wherein the means defining grooves includes radially disposed grooves in the floor member for receiving bottom edges of the partition means.

4. The container assembly of claim 3 wherein the means defining grooves also includes vertically aligned grooves at the inner surface of the cylindrical side wall of the cylindrical body for receiving side edges of the partition means.

5. The container assembly of claim 1 wherein the panel means is of resilient plastic composition.

6. The container assembly of claim 5 wherein the panel means comprises two rectangular panels each having side, top and bottom edges, means for joining the side edges of one panel to the side edges of the other panel, the joining means including means for holding margins of the panels adjacent the side edges substantially co-extensive thereby preventing hinging at the joints and thereby causing the panels to cooperatively assume a cylindrical shape.

7. The container assembly of claim 1 wherein the partition means comprises a plurality of partition panels projecting radially from a common central axis, means on the inner side wall of the cylinder defining vertical grooves for receiving the side edges of the partition panels to block them from rotating within the cylinder, the partition panels extending above the top of the cylinder, the portions of the panels above the top of the cylinder having side edges including portions curved inwardly and thereabove portions extending upwardly to collectively depict in outline shape a replica of a bottle, and a cylindrical cap fitted around the upwardly extending portions of the partition panels.

8. The container assembly of claim 7 wherein the cylindrical cap comprises a normally flat sheet stressed to a cylindrical shape bringing the side edges thereof into proximity with one another, means to releasably join together the side edges of the sheet, and a circular lid fitted onto the top of the cylindrical sheet.

9. The container assembly of claim 8 wherein the lid comprises a flat round member with a downwardly extending annular flange, detent means projecting outwardly from the periphery of the cylindrical cap adjacent the upper edge thereof, and annular groove means in the annular flange for receiving the detent means to releasably hold the lid on the cylindrical cap.

10. A container assembly for containing and displaying products wherein the assembly consists of a plurality of substantially flat components prior to formation of the assembly, comprising a rectangular panel having side edges formed of a resilient material having a memory biasing the panel toward a normally flat condition, elongated joining means on opposite margins of the panel adjacent the side edges thereof defining complementary fasteners such that, when the panel is curved to form a cylinder, the said opposite edges are brought into juxtaposition relative to one another enabling the fasteners to be engaged with one another to hold the panel in the cylindrical form, at least one joining means adjacent one side edge having a flange of stiff composition adapted to lie against the inner margin adjacent the opposite side edge to resist hinging at the joint between the edges, a plurality of flat partitions having mutually complementary slots along their central vertical axes enabling the partitions to be assembled together in a radial array for insertion within the cylinder with the side edges of the partitions in contact with the inner side wall of the cylinder.

11. The container assembly of claim 10 including a pair of elongated joists each having a length substantially equal to the internal diameter of the cylinder, complimentary slots in the joists at the centers intermediate the ends thereof enabling the joists to be fitted together to form a cross and thereafter to be fitted as a unit within the cylinder adjacent the bottom thereof, and a round plate having a diameter slightly less than the inner diameter of the cylinder for inserting into the cylinder to rest on the joists and form a floor within the cylinder.

12. The container of claim 11 including brackets projecting from the inner surface of the cylinder having upper surfaces substantially coplanar with the upper surfaces of the joists, the brackets being located intermediate the ends of the joists about the periphery of the cylinder.

13. The container of claim 10 including means on the inner wall of the cylinder defining vertical grooves to receive the side edges of the partitions.

14. The container assembly of claim 10 wherein the fasteners comprise an elongated generally J-shaped channel member extending along one panel edge, defined by a long leg portion and a short leg portion, an elongated generally G-shaped channel member extending along the other panel edge, the G-shaped channel member having a long leg portion overlying the long leg portion of the J-shaped channel member when the panel is curved to form a cylinder, the G-shaped channel member also having a short leg portion extending from the long leg portion and formed in the shape of a cup the opening of which faces the long leg portion of the G-shaped channel member, the short leg portion of the J-shaped channel member being sized to be received within the cup defined by the short leg portion of the G-shaped channel member.

15. The container of claim 14 including a flange integral with the G-shaped channel member overlying and rigidly fastened to the panel adjacent the said one edge, and means rigidly fastening the long leg portion of the J-shaped channel member to the panel adjacent the said other edge.

16. The container assembly of claim 15 wherein the short leg portion of the G-shaped channel member has a free edge, the space between the free edge and the long leg portion of the G-shaped channel member being great enough to receive the short leg portion of the J-shaped channel in one relative position of the channel members.

17. In a cylindrical container or the like having a body formed of at least one resilient panel, first and second edges on opposite sides of the panel, a first channel member secured to the panel adjacent the first side edge thereof, a second channel member secured to the panel adjacent the second side edge thereof, the channel members each being of substantially constant cross section, a portion of the first channel member being of hook-like configuration with a concave side and a convex side, a portion of the second channel member defining a receptacle having an opening in a side thereof for receiving the hook-like portion, a rib projecting from a side of the receptacle for introduction into the concave side of the hook-like portion when the hook-like portion is received within the receptacle, the rib projection defining one boundary of the opening, the receptacle including a wall extending around the convex side of the hook-like portion, the wall having a termination defining another boundary of the opening, the termination of the wall being spaced toward the second edge of the panel relative to the rib projection, whereby the size of the opening facing the hook-like protion can be varied by pivoting the second channel member relative to the first channel member.

18. The combination of claim 17 including a first rigid flange extending from the termination of the wall overlying a margin of the panel adjacent the first side edge, a second rigid flange substantially parallel to the first flange extending from the wall and overlying a margin of the panel adjacent the second side edge, the flanges being located on the inner side of the cylinder.

19. The combination of claim 18 wherein the hook-like portion is acruate and the wall is arcuate.

20. The combination of claim 18 wherein the second flange is secured to the panel, a third flange integral with the hook-like portion overlying and secured to a margin of the panel adjacent the first side edge.

21. The combination of claim 17 including means supported adjacent the lower edge of the cylinder for supporting a horizontal floor within the cylinder, a round floor for positioning on the supporting means, at least one partition having a bottom edge resting on the floor and side edges adjacent the inner surface of the cylinder, and means to prevent rotation of the partition within the cylinder.

22. The combination of claim 21 including means for fastening the partition to the cylinder enabling lifting the cylinder by grasping the partition.

23. In a container or the like having a body formed of at least one resilient normally flat panel having parallel first and second side edges adjacent first and second margins of the panel, wherein the panel is adapted to be stressed to a curved configuration about an axis parallel to the side edges thereof to form a cylinder, wherein each panel has a first channel member connected to the panel adjacent the first side edge thereof and a second channel member connected to the panel adjacent the second side edge thereof, the channel members comprising, hook means on the first channel member, hook receptacle means on the second channel member complementary to and interfittable with the hook means when the second channel member is in a first pivotal position relative to the first channel member, wherein in the first pivotal position the first margin of a panel is substantially coplanar with the second margin of a panel, means on the channel members operable against one another to define stops preventing release of the interfitted hook means and hook receptacle means in a second pivotal position of the second channel member relative to the first channel member, wherein in the second pivotal portion the first and second margins are stressed to curved shapes about the said axis, relatively stiff flanges on one of the channel members overlying the first and second margins on the concave side thereof to prevent hinging along the interfit between the hook means and the hook receptacle means, and means to prevent either channel member from pivoting relative to the panel to which it is connected.

24. The combination of claim 21 including partition means within the cylinder having side edges adjacent the inner wall of the cylinder, means defining vertical grooves on the inner side wall of the cylinder for receiving the side edges of the partition means, the partition means projecting above the top of the cylinder to present an outline shaped like the upper portion of an article.

25. A container assembly for containing and displaying products comprising a hollow cylindrical body defined by resilient normally flat panel means curved to form a cylindrical side wall, the panel means having first and second side edges parallel to one another, fastening means for joining the side edges of the panel means to releasably form the panel means in a cylindrical shape, the fastening means comprising an elongated generally J-shaped channel member extending along the first side edge, defined by a long leg portion and a short leg portion, an elongated generally G-shaped channel member extending along the second side edge, the G-shaped channel member having a long leg portion overlying the long leg portion of the J-shaped channel member when the panel is curved to form a cylinder, the G-shaped channel member also having a short leg portion extending from the long leg portion and formed in the shape of a cup the opening of which faces the long leg portion of the G-shaped channel member, the short leg portion of the J-shaped channel member being sized to be received within the cup defined by the short leg portion of the G-shaped channel member.

26. The container of claim 25 including a flange integral with the G-shaped channel member overlying and rigidly fastened to the panel adjacent the said one edge, and means rigidly fastening the long leg portion of the J-shaped channel member to the panel adjacent the said other edge.

27. Tne container assembly of claim 26 wherein the short leg portion of the G-shaped channel member has a free edge, the space between the free edge and the long leg portion of the G-shaped channel member being great enough to receive the short leg portion of the J-shaped channel in one relative position of the channel members.

* * * * *

UNITED STATES PATENT OFFICE

CERTIFICATE OF CORRECTION

Patent No. 4,610,363 Dated September 9, 1986

Inventor(s) Paul Flum and Jerry M. Mynatt

It is certified that error appears in the above-identified patent and that said Letters Patent are hereby corrected as shown below:

Column 5, line 17, after "23" and before "an" insert --is--.

Signed and Sealed this

Seventeenth Day of February, 1987

*Attest:*

DONALD J. QUIGG

*Attesting Officer* *Commissioner of Patents and Trademarks*